United States Patent [19]

Jesperson

[11] Patent Number: 4,732,306

[45] Date of Patent: Mar. 22, 1988

[54] ONE-REVOLUTION STOP MECHANISM AND DISPENSING METHOD FOR ROLLED WEB DISPENSERS

[75] Inventor: Paul W. Jesperson, Herlev, Denmark

[73] Assignee: Georgia-Pacific Corporation, Atlanta, Ga.

[21] Appl. No.: 838,799

[22] Filed: Mar. 12, 1986

[51] Int. Cl.[4] ..... B26F 3/02; A47K 10/36

[52] U.S. Cl. ..... 225/2; 225/4; 225/12; 225/96; 225/106; 226/129

[58] Field of Search ..... 225/2, 4, 12, 14, 96, 225/106; 83/337; 226/129, 130

[56] References Cited

U.S. PATENT DOCUMENTS

| | | | |
|---|---|---|---|
| Re. 28911 | 7/1976 | Jespersen et al. | 225/106 |
| 1,224,224 | 5/1917 | Shelley | 226/129 |
| 2,067,760 | 1/1937 | Harvey | 226/130 X |
| 2,183,187 | 3/1939 | Freeman . | |
| 2,826,373 | 7/1955 | Schwartz . | |
| 2,886,226 | 5/1959 | Batlas et al. | 225/96 |
| 2,892,579 | 6/1959 | Hubers | 225/12 |
| 3,017,131 | 1/1962 | Wooster . | |
| 3,575,328 | 4/1971 | Jespersen et al. | 225/2 |
| 4,073,422 | 2/1978 | Palter . | |
| 4,122,738 | 10/1978 | Granger | 83/337 X |

FOREIGN PATENT DOCUMENTS 2639810 3/1978 Fed. Rep. of Germany .

*Primary Examiner*—Frank T. Yost

*Attorney, Agent, or Firm*—Banner, Birch, McKie & Beckett

[57] ABSTRACT

A stop mechanism for a feed roller associated with a cutter in a dispenser for flexible rolled web material has a stop lever mounted to pivot in a plane normal to a feed roller rotational axis, such lever having a slot with lift and stop flanges disposed on opposite sides of the slot, respectively. A feed wheel rotatable with the feed roller has a control tab to successively engage with the lift and stop flanges so that as the feed roller rotates by web material being pulled from the dispenser, the control tab first lifts the stop lever by means of the lift flange and then abuttingly frictionally engages with the stop flange to retain the stop lever in its lifted position and stop feed roller rotation until the frictional engagement is relieved by pulling tension on the web being terminated whereupon the lever drops until the tab can pass over the upper end of the stop flange to free the feed roller for further rotation.

12 Claims, 8 Drawing Figures

ONE-REVOLUTION STOP MECHANISM AND DISPENSING METHOD FOR ROLLED WEB DISPENSERS

BACKGROUND OF THE INVENTION

This invention relates to a dispenser and dispensing method for rolled web material and, more specifically, for flexible sheet material such as paper toweling wherein a stop mechanism is associated with the feed roller in the dispenser to allow the feed roller to undergo one revolution and then be stopped in dispensing an individual sheet of the rolled web material.

Dispensers for rolled flexible sheet material, such as paper toweling, are well-known in the art and many of these dispensers include mechanisms for perforating or severing a web of material to divide the web into individual sheets. Towel dispensers have also been developed with various mechanisms or techniques to provide a waste-restricting system, namely, the dispenser permitting only a single individual sheet to be dispensed to the intending user at one time with a delay being provided before the user can gain access to a second individual sheet.

For sanitary reasons, towel dispensers in public washrooms should preferably be operable by merely pulling down on a exposed portion of the towel web with no need to touch parts of the dispenser such as cranks, buttons or levers commonly present in many prior art types of towel dispensers, these actuators serving to activate the towel dispenser in supplying a length of towel web or individual toweling sheets.

At the same time, for the sake of economy, the dispenser should eliminate unnecessary waste of paper toweling while still not unduly restricting use of the toweling to the intending user. Certain dispensers now on the market accomplish these objectives by such devices as spring-operated feeding mechanisms and vacuum cup timers. Spring-operated devices have the disadvantage that in being cocked while the towel is being withdrawn from the dispenser, a substantial drag is placed on the web of paper toweling often resulting in it being prematurely torn where it is held by the wet fingers of the intending user. Vacuum cup timers, in providing needed time intervals between withdrawal of individual towel sheets to thus reduce waste have the disadvantage that the desired preset time intervals cannot be reliably maintained especially at very short time interval settings.

SUMMARY OF THE INVENTION

The rolled web dispenser of this invention basically overcomes the above-mentioned disadvantages by eliminating the use of feed-out springs or vacuum cup timers thereby providing a fully reliable momentary stop and time delay. Thus the invention makes possible the use of very soft and weak paper toweling with the dispenser being operated solely by pulling on the paper web of toweling while still providing the desired waste restricting system.

The dispenser for rolled web flexible material of this invention overcomes the objections discussed above with reference to prior art proposals by providing a stop mechanism for the feed roller within a dispenser cabinet, the roller having a cutter associated therewith to transversely perforate the web as it passes over the feed roller to the exterior of the cabinet. A stop lever is mounted to pivot in a plane normal to the feed roller rotational axis, this lever having a slot with lift and stop flanges disposed on opposite sides of the slot, respectively.

A feed wheel rotatable with the feed roller has a control tab to successively engage with the lift and stop flanges so that as the feed roller rotates by web material being pulled from the dispenser, the control tab first lifts the stop lever by means of the lift flange and then abuttingly frictionally engages with the stop flange to retain the stop lever in its lifted position and stop the feed roller from rotating until the frictional engagement is relieved by pulling tension on the web being terminated. Then the stop lever drops until the control tab is in a position to pass over the upper end of the stop flange thereby freeing the feed roller for further rotation.

The dispensing method invention for rolled web material involves transversely perforating the web material within the dispenser cabinet to define individual sheets along the web with a row of perforations formed between one sheet and the next succeeding sheet; then freeing the web for it to be pulled out of the cabinet by an intending user until the row of perforation is exposed exteriorly of the cabinet. When this event occurs, then abruptly stopping the freedom for the web material to be pulled out. The pull applied by the intending user thereupon separates the web along the row of perforations for the user to receive an individual sheet. The separation of this individual sheet from the web results in relieving tension on the web. This relief of tension is utilized to again free the web to be pulled out of the cabinet by an intending user.

To assure that reverse rotation of the feed roller does not occur when the control tab passes from beneath the lift flange, there is a retainer means associated with the lift flange positioned to cooperate with the control tab and prevent its reverse movement back beneath the lift flange. At this stage the control tab would be in frictional abutting engagement with the stop flange to prevent feed roller rotation until pulling tension on the web is terminated.

With the foregoing in mind, it is an object of the present invention to provide a flexible rolled web dispenser having a stop mechanism which will provide a reliable momentary stop with a definite short time delay.

It is also an object of the invention to provide a dispenser incorporating a stop mechanism as described in the above object with the dispenser being capable of handling very soft and weak paper toweling, the dispenser being operated solely by pulling on the paper web.

An additional object of the invention is to provide a rolled web dispenser where the web is transversely perforated to define individual sheets along the web and a stop mechanism is incorporated in the dispenser, the dispenser being compact, rugged economical to manufacture and fully suited for commercial and private installations.

The above and other objects of the invention will become apparent upon consideration of the detailed description of a preferred embodiment of the invention in connection with the accompanying drawings.

DESCRIPTION OF THE PREFERRED EMBODIMENT

Figure 1:
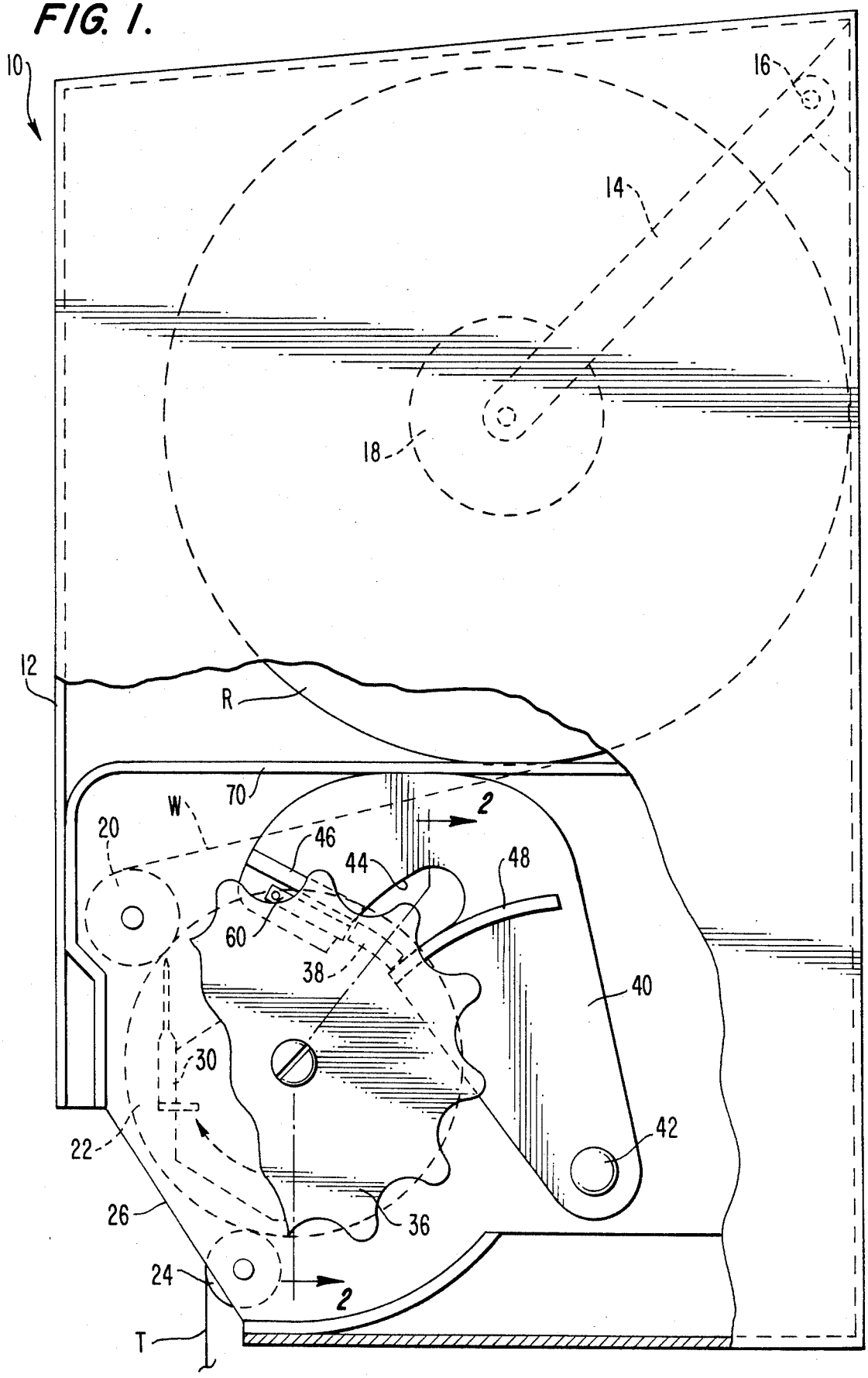
FIG. 1 is a side elevational view with portions in section of the rolled web dispenser of this invention displaying the stop lever associated with the feed roller and feed wheel.

On FIG. 1, the dispenser 10 of this invention is shown having a cabinet 12 adapted to be mounted at a convenient location for intending users of the paper toweling supplied from the rolled web material carried within the cabinet 12. A portion of the cabinet 12 is broken away to display the one-revolution stop mechanism and other components mounted within the cabinet 12.

A roll R of flexible web material is mounted on a yoke 14, the yoke being pivoted at 16 to the backplate of the dispenser cabinet 12. Yoke 14 has a pair of yoke arms with cups 18 rotatably mounted at the outer ends of the yoke arms, these cups being inserted at each core end into the central tubular core of the towel roll R. With this rather conventional mounting for roll R, due to gravity the roll rests against the backplate of cabinet 12 to provide a slight braking action and prevent overspinning of the roll when the paper towel web is being removed.

The web W withdrawn from roll R is threaded counterclockwise around a pinchroller 20. The web then passes clockwise around the rearside of a feed roller 22 to pass counter-clockwise over an exit pinchroller 24. Pinch rollers 20 and 24 are pressed against the feed roller 22 by springs (not shown) with all rollers being supported by appropriate bearings (not shown) in the sideplates of the dispenser cabinet 12. The web then exits through opening 26 in cabinet 12 to be accessible to intending users of the paper toweling material coming from roll R. Preferably a tab length T of the toweling web W of about 3 inches will extend outside the dispenser beyond opening 26 to be available for grasping by the intending users of the web material. This preferred lenth T of web material is automatically fed from the dispenser 10 in conjunction with operation of the stop-mechanism to be described hereinafter.

The feed roller 22 has an internal knife 30 which is mounted laterally offset from the rotational axis of feed roller 22. Knife 30 is supported within the feed roller to project through an opening (not shown) in the feed roller periphery to essentially severe the web material when it passes over the feed roller surface as the feed roller 22 makes a single revolution. The web material is thus perforated to leave only three uncut ¼ inch long tabs connecting successive sheets in the web. This transverse perforating of the web material in cabinet 12 defines individual sheets which are of a length equal to the feed roller circumference so that the web W is formed with a row of perforations between one sheet and the next succeeding sheet.

Details of the mounting and operating mechanism for the cutting knife 30 are not shown but the construction may be of the sliding cutter construction disclosed in Holger Rasmussen patent application Ser. No. 788,837 filed Oct. 18, 1985.

Figure 2:
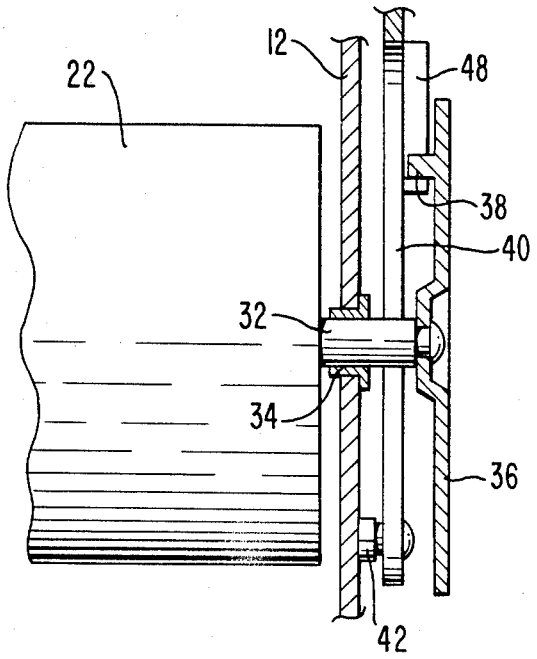
FIG. 2 is a sectional view taken on line 2—2 of FIG. 1.

Feed roller 22 is rotatably mounted by shaft 32 which extends through bearing 34 carried by the sidewall of cabinet 12 as shown on FIG. 2. Shaft 32 extends outwardly beyond bearing 34 and has a feed wheel 36 fixedly secured to its outer end. The feed wheel 36 has a control tab 38 which cooperates with a stop-lever 40 to constitute the active component of the stop-mechanism as will be described hereinafter.

Stop-lever 40 is pivotally mounted at 42 on one of the sideplates of the dispenser cabinet 12. This pivotal mounting of stop lever 40 disposes it between the feed wheel 36 and sideplate of the cabinet 12 as shown in FIG. 2.

The stop-lever is provided with a slot 44. This slot 44 enables the stop-lever 40 to pivot around pivotal mounting 42 with the slot being disposed to pass around shaft 32 during pivoting movements of the stop-lever, shaft 32 mounting both feed roller 22 and feed wheel 36.

The surface of stop-lever 40 facing the surface of feed wheel 36 which carries control tab 38 is provided with a lift flange 46 and a stop flange 48. As will be explained, the feed roller 22 and feed wheel 36 rotate the control tab 38 into interengagement with lift flange 46 and stop flanges 48 to carry out the functioning of the stop mechanism. It will be noted that the lift flange 46 extends generally radially relative to the pivotal mounting 42 of lever 40. With the two flanges mounted on opposite sides of the slot 44, the stop flange 48 extends generally along one side of slot 44 to be generally perpendicular to the lift flange 46 and spaced from such flange by the width of slot 44.

Figure 5:
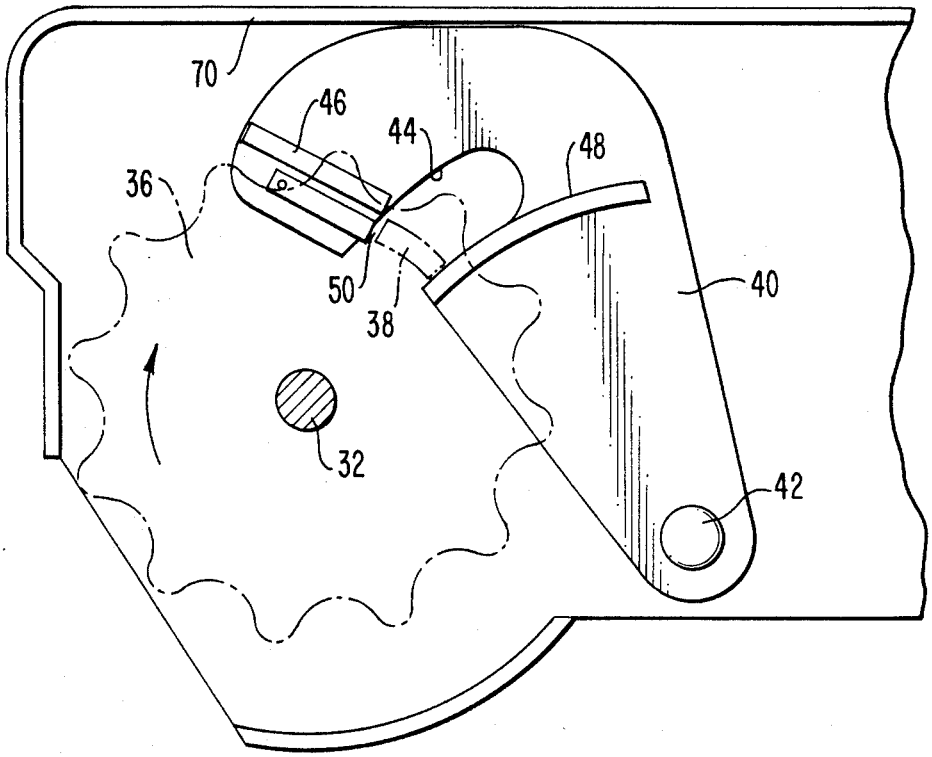
FIG. 5 is a view similar to FIG. 3 showing the control tab after passing beneath the lift flange into frictional abutting engagement with the stop flange.

The spacing between the adjacent ends of flange 46 and flange 48 is slightly greater than the length of control tab 38, thereby leaving a small space 50 (see FIG. 5) between the lift flange 46 and control tab 38 when tab 38 is pressed into abutting frictional engagement with the surface of stop flange 48. This surface of flange 48 is slightly curved toward the pivotal mounting 42 of stop lever 40 for a purpose which will be explained hereinafter.

The stop lever 40 is also provided with a spring retainer 60. As shown on FIG. 8, retainer 60 is in the form of a leaf spring with one end fixed at 62 in a groove formed in the surface of stop lever 40. This retainer 60 lies along the surface of lift flange 46 to cooperate with the control tab 38 when the tab has passed from beneath the lift flange 46 into frictional abutting engagement with stop flange 48, the leaf spring retainer 60 then preventing reverse rotation of feed wheel 36 and feed roller 22.

The general operation of the stop-mechanism involves having stop flange 48 so located relative to the cutting knife 30 within the feed roller 22 that when control tab 38 engages with stop flange 48, the perforations on the towel web will have reached a point where tab T extends about 3 inches outside the dispenser as shown on FIG. 1. As the intending user continues pulling toweling from the dispenser, the sudden stop when tab 34 engages stop flange 48 will cause the free uncut tabs along the perforations in the web to break off thus delivering a cut off sheet of toweling into the user's hands and leaving the exposed web tab T for the next user. Basically the stop lever 40 not only stops the feed roller 22 from rotation but also (1) releases the feed roller for further rotation as soon as the web is broken off along the perforations, (2) keeps the stop engaged until the web is broken off and (3) accomplishes these functions no matter how slowly or fast the web is withdrawn from the dispenser.

The specific details of operation of this stop-mechanism may best be understood by the progressive operating conditions shown on FIGS. 3–7 on the drawings.

Figure 3:
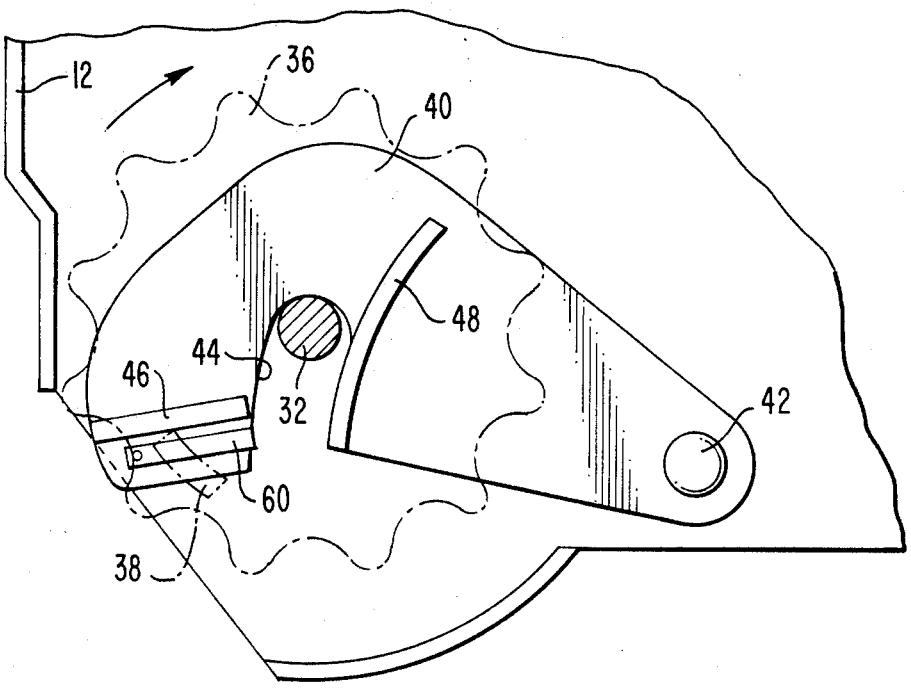
FIG. 3 is an enlarged view of the stop lever pivotally mounted on a portion of the dispenser cabinet, the feed wheel and control tab being shown in phantom.
Figure 4:
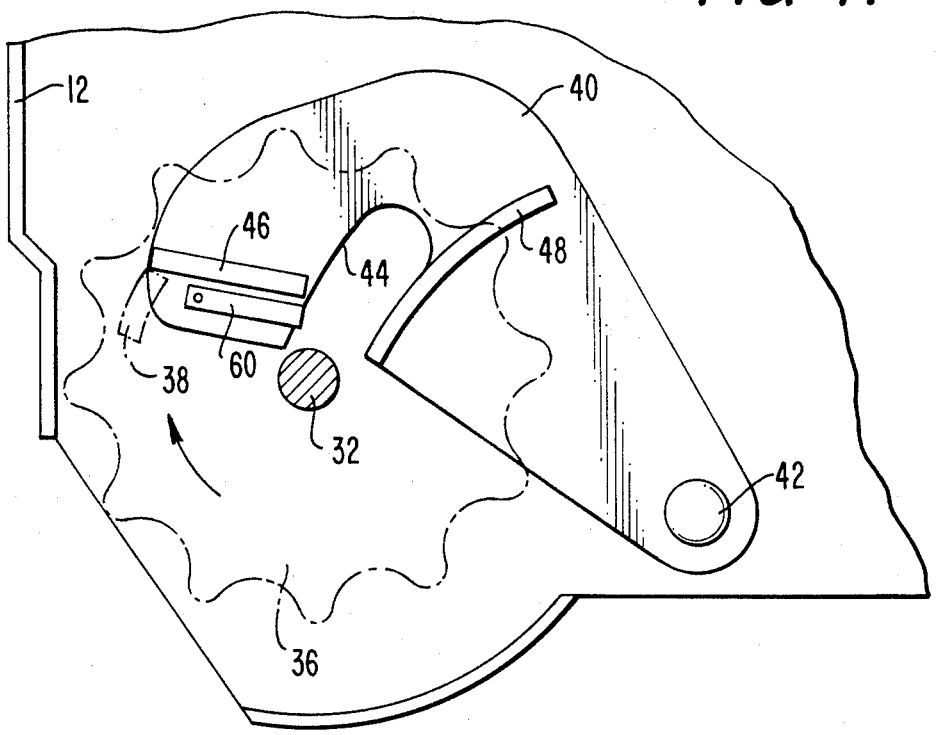
FIG. 4 is a view similar to FIG. 3 showing the stop lever partially lifted by the control tab carried by the feed wheel.

In FIG. 3, the stop lever 40 is in its dropped position with slot 44 having passed down around shaft 32 to be resting on shaft 32. The control tab 38 on feed wheel 36 has rotated to a point where it is contacting the lift flange 46 on stop lever 40. Further rotation of feed wheel 36 and feed roller 22 acts to lift stop lever 40 such as shown on FIG. 4. This lifting action continues until control tab 38 abuttingly engages with stop flange 48 bringing the feed wheel and feed roller to an abrupt stop at the position shown in FIG. 5.

At the stop position, it will be noted that at the center of the mating surfaces of control tab 38 and stop flange 48, the angle between the lines extending toward the feed wheel axis of shaft 32 and the stop lever pivotal mounting 42 is 90°, thus preventing pressure applied by control tab 38 against stop flange 48 from moving the stop lever 40 either up or down. It should also be noted that as control tab 38 passes out from beneath the lift flange 46 a small space 50 separates the control tab and lift flange to allow the stop lever to drop.

Figure 8:
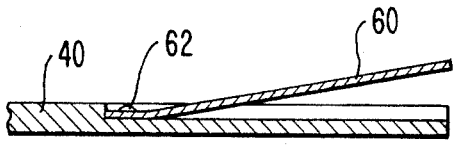
FIG. 8 is a sectional view of the retainer taken on line 8—8 of FIG. 6.

The leaf spring retainer 60, partially recessed into the face of stop lever 40 as shown in FIG. 8, protrudes out of this recess at its outer end. This upwardly protruding end thus prevents control tab 38 from bouncing back under the lift flange 46 once the control tab hits the stop flange 48. Should the control tab be able to bounce back beneath the lift flange 46, such would prevent the stop lever 40 from dropping and thereupon releasing the feed roller and feed wheel for rotation.

It will be noted that the extent of upward movement of the stop lever 40 is limited by its engagement with the flange 70 carried by the sideplate of the dispenser cabinet 12.

Figure 6:
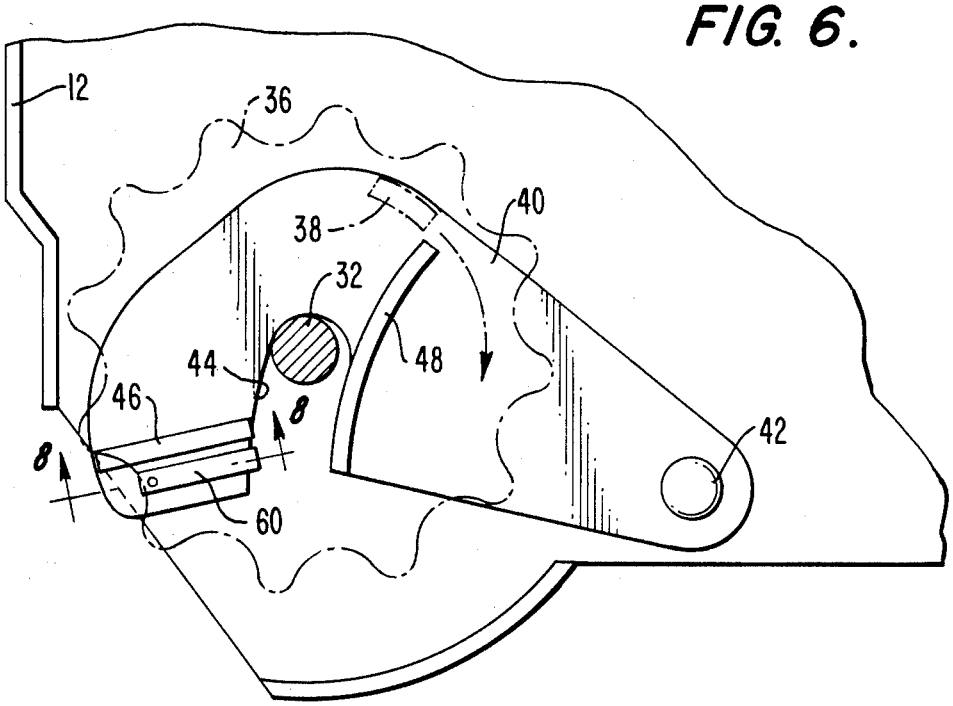
FIG. 6 is a view similar to FIG. 3 with the stop lever down and control tab positioned to pass over the stop flange.

As long as control tab 38 and stop flange 48 are pressed together by the existence of a pull on the web, the friction between these components prevents the stop lever from dropping. When the towel is torn off, such pressure is immediately released such as to allow the stop lever 40 to drop by gravity to the position as shown in FIG. 6. As described hereinabove, the curve of the mating surface of stop flange 48 is so designed that as the stop lever drops, the surface of flange 48 moves slightly away from control tab 38 on the feed wheel 36 to prevent any interference between the control tab and stop flange while the stop lever 40 is dropping to the position shown on FIG. 6 where the slot 44 again rests on the shaft 32.

When a sheet of toweling is torn off and the stop lever has dropped to rest on shaft 32, the space above the stop flange 48 is sufficient to allow the control tab 38 to pass around and above stop flange 48 thus again permitting the feed wheel and feed roller to rotate forwardly for another cycle of the dispenser as shown on FIG. 6.

Figure 7:
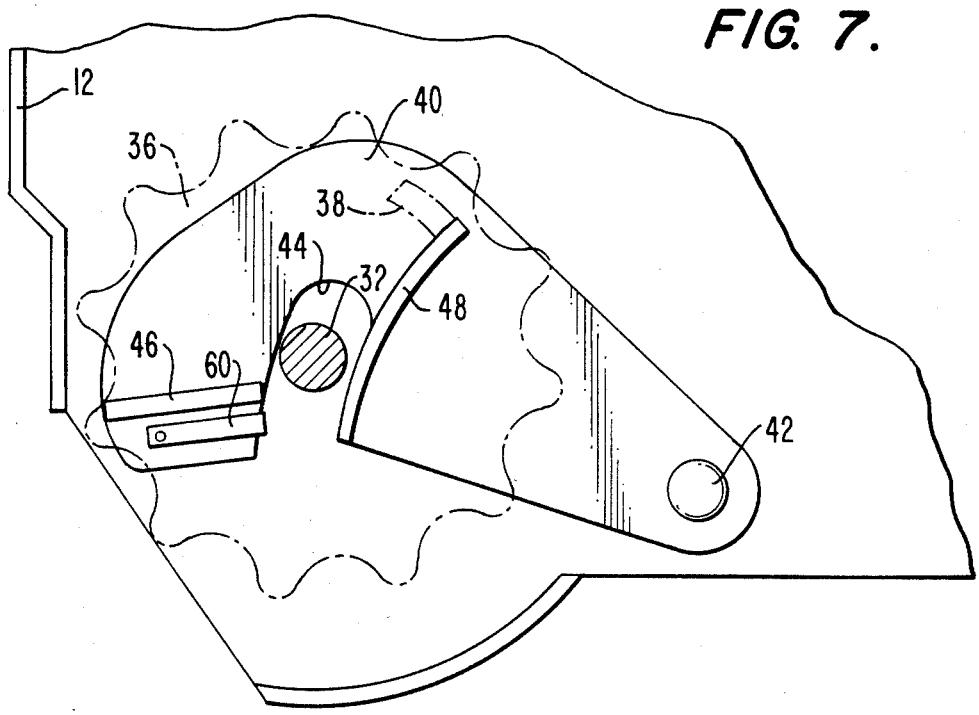
FIG. 7 is a view similar to FIG. 5 showing the control tab frictionally engaging the stop flange at a higher level.

The unique features of the stop lever 40 may be seen on FIG. 7. Due to the space 50 between the lift flange 46 and the control tab 38 on the feed wheel 36, as control tab 38 leave the lift flange, the stop lever, due to gravity begins to drop immediately. On other prior stop levers in use, this premature drop has been prevented by various timing devices that hold the stop lever for a few seconds. Such timing mechanisms are either expensive or unreliable, especially at short fractional second settings.

By extending stop flange 48 along the surface of stop lever 40 for a substantial distance and raising stop lever 40 to a high level relative to the lever pivot 42 as shown on FIG. 1 an automatic time delay is provided due to the time needed for the stop lever to start and then drop by gravity through the additional high lift. It will be noted that at the full high lifted position of lever 40 as shown on FIG. 1, the lever is almost above its pivotal mounting 42. Therefore, the center of gravity of the lever 40 more closely overlies pivot 42 than when the lever has fully dropped as shown in FIG. 6. Thus in the high lifted position there is less of a tendency for the lever 40 to start and rapidly accelerate pivoting about pivot 42 down to its dropped position shown in FIG. 6. This assures that control tab 38 will engage stop flange 40 and stop downward dropping of lever 40.

For example, an extra lift of 1.2 inches provides a timing interval of ⅔ of a second. Due to the short space 50 (see FIG. 5) the towel web can be pulled out as slowly as 1½ inches per second and still be stopped by the stop lever. With a 9 inch long towel, this means that it can be pulled out as slowly as over a 6 second time interval and still be stopped. The design thus provides adequate waste restriction without need for complicated timing mechanisms. It should also be noted that depending upon the speed at which the towel is pulled from dispenser 10, control tab 38 will strike stop flange 48 at varying points along the surface of stop flange 48.

It should be obvious from the above-discussed apparatus embodiment that numerous other variations and modifications of the apparatus of this invention are possible, and such will readily occur to those skilled in the art. Accordingly the scope of this invention is not to be limited by the embodiment disclosed, but is to include any such embodiments as may be encompassed within the scope of the claims appended hereto.

I claim:

1. A method of dispensing rolled web material comprising the steps of:

transversely perforating the web material within a dispenser cabinet to define individual sheets along the web with a row of perforations formed between one sheet and the next succeeding sheet;

freeing the web for it to be pulled out of said cabinet by an intending user until said row of perforations existing between succeeding sheets is exposed exteriorly of said cabinet;

abruptly stopping the freedom for said web material to be pulled out of said cabinet to provide a stopping action, effecting said stopping action by raising a pivotted stop member against the force of gravity at least 1.2 inches beyond the point necessary to insure said stopping action to provide a predetermined time delay due to the time interval required for the stop member to drop by the force of gravity to the point where said stopping action is released;

maintaining said web stopped after said one sheet has been pulled from said cabinet by applying continuous pulling tension to said web;

pulling said one sheet to separate it from said web along said row of perforations thereby relieving tension on said web;

utilizing relief of tension on said web to again free said web to be pulled out of said cabinet by an intending user.

2. A method of dispensing rolled web material as recited in claim 1 wherein abruptly stopping freedom for said web to be pulled out of said cabinet occurs when a portion of said next succeeding sheet is exposed exteriorly of said cabinet.

3. A dispenser for rolled web material comprising:

a dispenser cabinet having means in said cabinet for mounting a roll of web material;

a feed roller rotatably mounted on shaft means in said cabinet to guide web from the roll to the exterior of said cabinet;

cutter mechanism associated with said feed roller to transversely perforate the web as it passes over said feed roller;

control tab means rotatable with said feed roller and spaced radially from the feed roller axis;

lever means mounted to pivot in a plane normal to said feed roller axis having a slot disposed to pass around said shaft means during pivoting movements of said lever means;

lift flange means carried by said lever means disposed on one side of said slot to be engaged by said control tab means to raise said lever to a high level as said feed roller rotates; and stop flange means carried by said lever means on the other side of said slot to abuttingly frictionally engage said control tab means after said tab means has fully raised said lever means and passed from beneath said lift flange means, said stop flange means thereupon holding said lever means and preventing feed roller rotation until pulling tension on the web is terminated.

4. A dispenser for rolled web material as recited in claim 3 wherein a feed wheel is fixedly secured to said shaft means and said control tab means is carried by said feed wheel.

5. A dispenser for rolled web material as recited in claim 3 wherein said cutter mechanism includes a cutting blade mounted within said feed roller.

6. A dispenser for rolled web material as recited in any one of claims 3, 4 or 5 wherein both of said flange means project laterally from said lever means with said lift flange means extending generally radially relative to the lever pivot and said stop flange means extending generally along said other side of said slot.

7. A dispenser for rolled web material as recited in claim 6 wherein retainer means is associated with said lift flange means to cooperate with said control tab means and prevent reverse rotation of said feed roller after said tab means has passed from beneath said lift flange means.

8. A dispenser for rolled web material comprising:

a dispenser cabinet having means in said cabinet for mounting a roll of web material;

a feed roller rotatably mounted on shaft means in said cabinet to guide web from the roll to the exterior of said cabinet;

control tab means rotatable with said feed roller and spaced radially from the feed roller axis;

lever means mounted to pivot in a plane normal to said feed roller axis adjacent to said control tab means;

lift flange means carried by said lever means to be engaged by said control tab means to raise said lever to a high level as said feed roller rotates; and stop flange means carried by said lever means to abuttingly frictionally engage said control tab means when said tab means has fully raised said lever means and passed from beneath said lift flange means, said stop flange means thereupon holding said lever means and preventing feed roller rotation until pulling tension on the web is terminated.

9. A dispenser for rolled web material as recited in claim 8 wherein said lift flange means extends generally radially relative to the lever pivot and said stop flange extends generally perpendicular to said lift flange means and is spaced therefrom.

10. A dispenser for rolled web material as recited in claim 8 wherein a feed wheel is fixedly secured to said shaft means and said control tab means is carried by said feed wheel.

11. A dispenser for rolled web material as recited in claim 8 wherein said dispenser has a cutter mechanism including a cutting blade mounted within said feed roller.

12. A dispenser for rolled web material as recited in any one of claims 9, 10, 11 or 12 wherein retainer means is associated with said lift flange means to cooperate with said control tab means and prevent reverse rotation of said feed roller after said tab means has passed from beneath said lift flange means.

* * * * *